US005201973A

United States Patent [19]

Castaldo et al.

[11] Patent Number: 5,201,973

[45] Date of Patent: Apr. 13, 1993

[54] NON-CONTACT GLUING APPARATUS

[75] Inventors: Roger E. Castaldo, Alsip; Edward Nigohosian, Lansing; James DeCamp, Crete, all of Ill.

[73] Assignee: Mactron, Inc., Alsip, Ill.

[21] Appl. No.: 670,716

[22] Filed: Mar. 18, 1991

[51] Int. Cl.[5] ..... B05C 5/00; B05C 5/02

[52] U.S. Cl. ..... 118/669; 118/680; 118/682; 118/684; 118/703; 118/705; 118/707; 118/302; 118/314; 118/319

[58] Field of Search ..... 118/669, 676, 679, 680, 118/682, 684, 699, 707, 302, 314, 319, 703, 705; 156/357

[56] References Cited

U.S. PATENT DOCUMENTS

| | | | |
|---|---|---|---|
| 3,556,833 | 1/1971 | Nirenberg | 118/705 |
| 3,566,828 | 3/1971 | Christensen | 118/682 |
| 3,593,308 | 7/1971 | Fagan | 118/679 |
| 3,594,211 | 7/1971 | Drum | 118/669 |
| 3,938,467 | 2/1976 | Radowicz | 156/357 |
| 4,151,428 | 8/1979 | Morel | 118/707 |
| 4,382,422 | 5/1983 | Eddy et al. | 118/680 |
| 4,387,002 | 6/1983 | Knecht | 118/302 |
| 4,389,971 | 6/1983 | Schmidt | 118/669 |
| 4,408,562 | 10/1983 | DeCamp et al. | 118/702 |
| 4,433,237 | 2/1984 | Matt | 118/682 |
| 4,448,821 | 5/1984 | Buschor | 118/680 |
| 4,515,187 | 5/1985 | Schaumberg et al. | 118/680 |
| 4,527,510 | 7/1985 | Arndt | 118/669 |
| 4,696,256 | 9/1987 | Lenhardt | 118/680 |
| 4,768,462 | 9/1988 | Kuronaga et al. | 118/314 |
| 5,020,473 | 6/1991 | Bergman | 118/669 |

OTHER PUBLICATIONS

Tol-O-Matic Band Cylinders (6 pages), Tol-O-Matic, Inc. Feb. 1, 1989.

Reed Switches (catalog p. 10) Tol-O-Matic, Inc.

4-Way Solenoid Pilot Operated, Individual and Stacking Bodies 800 Series (pp. 800-1 & 800-2), MAC Valves, Inc.

SM512 Series Sensors (pp. 144 & 253), Banner Engineering Corp.

*Primary Examiner*—W. Gary Jones

*Assistant Examiner*—Todd J. Burns

*Attorney, Agent, or Firm*—Trexler, Bushnell, Giangiorgi & Blackstone, Ltd.

[57] ABSTRACT

Apparatus for applying a predetermined glue pattern to a predetermined surface of a workpiece, which workpiece is moved in a stepwise, indexed fashion, such that this predetermined surface thereof follows a given path. The predetermined pattern includes first portion which extends along a line which intersects the given path. The apparatus includes a non-contact glue valve having an outlet; a carrier for mounting the glue valve for bidirectional motion along the line intersecting the given path with the outlet thereof in alignment with the first portion of the predetermined pattern and spaced closely above the predetermined surface of the workpiece. A control is provided for turning the glue valve on and off in a predetermined fashion for depositing glue upon the predetermined surface of the workpiece in the first portion of the pattern.

13 Claims, 9 Drawing Sheets

NON-CONTACT GLUING APPARATUS

BACKGROUND OF THE INVENTION

This application is directed generally to a novel and improved non-contact type of gluing system and more specifically to a non-contact gluing system for applying one or more glue patterns to a surface of a workpiece such as a die-cut cup blank, which is indexed about a generally circular platform in the process of its manufacture and assembly.

Although the present invention will be illustrated and described herein with specific reference to the problem of applying the necessary glue patterns to paper cup blanks to allow the manufacture and assembly of cups therefrom, the principles of the invention may find utility in other applications. Generally speaking, the invention may find application in applying glue patterns to surfaces of moving workpieces wherein the patterns are to be applied in a direction generally parallel to the direction of movement of a workpiece, or wherein the pattern is to be applied in some direction intersecting or in a direction not parallel to the direction of movement (arcuate or otherwise) of the workpiece.

In a typical cup-forming machine, two generally circular platforms are utilized to fabricate and assemble completed paper cups from generally flat cup blanks. The first of these platforms is typically divided into six evenly spaced sections and rotates intermittently in a stepwise indexed fashion in a circular counterclockwise direction. Each incremental movement of the machine in this fashion constitutes an index. The cup blanks are die-cut and placed on the circular table at what is generally designated Station 0. The cup is then indexed to Station 1 where a seam or pattern of glue is to be applied to form the bottom seam of the cup. Hence, this first glue pattern is generally arcuately shaped, corresponding to the generally arcuate shape of the bottom edge of the cup blank. Another cup blank is placed at Station 0 with every index of the platform or table, and likewise each cup blank on the table is advanced to the next station in numerical order with each index of the table when the apparatus is operating properly. It is of course possible to have missed blanks in which case one or more stations on the table may be empty from time to time.

At Station 2 the side seam of glue is placed on the cup. The direction of the side seam is transverse to the arcuate movement of the cut cup blank, and generally extends from the arcuate bottom edge to the arcuate top edge along the line generally radial to the arcuate curvatures to the top and bottom edge respectively. This line may not be exactly radial to the circular movement of the table or platform, but may be characterized as being in a direction generally transverse thereto; that is, in a direction which would follow a line crossing a circle, or an arc of a circle describing the direction of travel of the platform or table. At Station 3 the cup is removed from this first platform or table and transferred to a mandrel which is carried on a second rotating platform or table wherein further steps of shaping and formation of the cup are carried out. Stations 4 and 5 of the first platform or table are typically idle.

The time required for the table to rotate or index from station to station may vary for different cup sizes and types. However, once the machine speed is set for a given cup type, the indexing time and rest time at each station remain constant. Typically, the duty cycle is approximately 40/60. That is, the cup is in motion about 40 percent of the time and is at rest in one of the stations about 60 percent of the time. For example, if the machine is set up to run 120 cups per minute, then the total time of movement and at rest for the cup in each station is 500 milliseconds. That is, the cup is in motion 40 percent or 200 milliseconds of that time and at rest in a given station 60 percent or 300 milliseconds of that time.

Presently, several methods for applying glue to the cup blanks are used. Two of the most commonly used methods are what are generally referred to in the industry as glue pots and stencils. A glue pot consists of a reservoir of glue which has a rotating rubber glue wheel, a portion of which rotates inside the reservoir and the remaining portion of which projects outwardly to apply glue to the cup blank or other workpiece. The width of the rubber wheel is selected to coincide with the desired width of the glue pattern to be applied.

In presently available machines, glue pots are used on Station 1 and Station 2 to apply the respective arcuate and transversely running glue patterns. At Station 1, the glue wheel is positioned above the table at the edge of the section closest to Station 2. As the cup indexes from Station 1 to Station 2, the glue wheel is mechanically lowered onto the cup and remains there until the entire glue pattern has been applied along the bottom edge of the cup. That is, as the cup indexes, the glue wheel rolls along its bottom edge and deposits the amount of glue required for the pattern. The wheel is then lifted back up into its position in contact with the glue pot to obtain glue for the next cup.

If the radius of the cup is not the same as that of the table at the gluing point, then the glue wheel is mechanically positioned so that it follows exactly the bottom arc of the cup when the table indexes. When the cup reaches the rest position at Station 2, a mechanical arm rolls a glue wheel across the side seam of the cup, and then lifts and retracts the glue wheel to its glue pot or reservoir. The glue is applied to the cup on the stroke of the arm back toward the center of the table. The glue wheel motion is controlled entirely by mechanical gearing which is driven from the drive mechanism for rotating the table.

Each size and type of cup requires a corresponding width of glue wheel and may also require adjustment to the positioning and/or line of travel of the glue wheel at respective Stations 1 and 2 to apply the correct pattern. With the mechanical controls of the glue pots, both gluing operations are performed at Station 1 and Station 2 with each index of the table, regardless of the presence or absence of a cup blank. Hence, in the event a cup blank is not supplied at Station 0, the glue pattern is applied to the top of the table at each of the Stations with the mechanical type of control currently available. This is undesirable in that the process must then be stopped to clean the top of the table.

The gluing process using stencils may also be used to apply patterns in the desired configuration at Station 1 and Station 2. A stencil which is the exact dimensions of the glue pattern to be applied is connected to a glue reservoir. At Station 1, when the cup is in the rest position, the stencil is stamped on to the cup, thus producing the arcuate bottom glue pattern. The stencil is then lifted back to a position above the cup where it is resupplied with glue from its reservoir. A second stencil at Station 2 having the dimensions of the side seam glue pattern is applied to the cup in the same manner when the cup is at rest at Station 2. The rate at which the stencils are applied to the cup is a function of the rate at which the table is indexed. Moreover, each different cup style and/or size has to be fitted with a corresponding matching stencil size for each of the two stencils. As with the glue pot technique, stencils are mechanically controlled by the table movement and are activated at each table index regardless of the presence or absence of a cup.

As indicated above, both the glue pot and stencil processes of cup gluing are controlled by a mechanical gearing which is driven from the motion of the table or platform itself. Accordingly, to change a machine set up from one style or size to another, it is necessary to change all of the related mechanical gearing, as well as either the wheel sizes and positions or directions of travel or the stencil sizes and positions. Due to the complicated mechanical gearing of the apparatus, such a changeover may take a skilled mechanic several days to accomplish. Hence, a relatively expensive piece of equipment must stand idle during the changeover, and a great deal of time and labor by relatively skilled personnel is required to accomplish the changeover.

Briefly, following the application of glue patterns to the generally flat cup blanks, the blank leaves the indexing table at Station 3 and is wrapped around a mandrel that has dimensions similar to that of an assembled cup. Compression is applied over the side seam of the cup on the mandrel by a mechanical arm. The mandrel is indexed in a clockwise direction to succeeding stations at which the cup is formed to completion before being stacked with completed cups. The compression on the side seam is done while the cup is stationary in Station 2*a*. When the cup is indexed to Station 3*a*, a fanning action is applied to the bottom of the cup on the mandrel. This creases the edge so that it can be folded over at the next Station 4*a*. At Station 4*a*, a stamping action is applied to the bottom of the cup. This compresses the glue pattern and fully forms the bottom of the cup. Heat is often applied at this station to insure a good glue bond.

At Stations 5*a* and 6*a*, the cup remains idle through each indexing period and continues to be compressed. At Station 7*a* the compression arm is lifted and cup is removed from the mandrel and delivered by air pressure through a curved tunnel to a station where the lip of the cup is rolled. Heat may also be applied at this station to aid the development of the lip. The cup, now fully formed, is again shot by air to a station where it is stacked. The cups are coated and are ready for use after they are removed from the stacking station. At a rate of 120 cups per minute, a new fully formed cup arrives at the stacking station every 500 milliseconds. Hence, each cup is completely formed in approximately 12 seconds. Typical cup rates, using this process range from 60 cups per minute to 180 cups per minute.

OBJECTS AND SUMMARY OF THE INVENTION

Accordingly, it is an object of this invention to provide a novel and improved non-contact type of gluing system for use in a cup-forming process or in similar processes.

A related object is to provide a novel and improved non-contact gluing system which is electrically and electronically controlled independently of the mechanical components of the cup-forming process and machinery.

Briefly, in accordance with the foregoing objects the invention provides an apparatus for applying a predetermined glue pattern to a predetermined surface of a workpiece, which workpiece is moved in a stepwise, indexed fashion, such that said predetermined surface thereof follows a given path of travel, said predetermined pattern including a first portion which extends along a line intersecting said given path, said apparatus comprising a non-contact glue valve having an outlet; carrier means for mounting said glue valve for bidirectional motion along said line intersecting said given path of travel with the outlet thereof in alignment with said first portion of said predetermined pattern and spaced closely above said predetermined surface of said workpiece; and control means for turning said glue valve on and off in a predetermined fashion for depositing glue upon said predetermined surface of said workpiece in said first portion of said pattern.

BRIEF DESCRIPTION OF THE DRAWINGS

The features of the present invention which are believed to be novel are set forth with particularity in the appended claims. The organization and manner of the operation of the invention, together with further objects and advantages thereof may best be understood by reference to the following description, taken in connection with the accompanying drawings in which like reference numerals identify like elements, and in which:

DETAILED DESCRIPTION OF THE ILLUSTRATED EMBODIMENT

Figure 1:
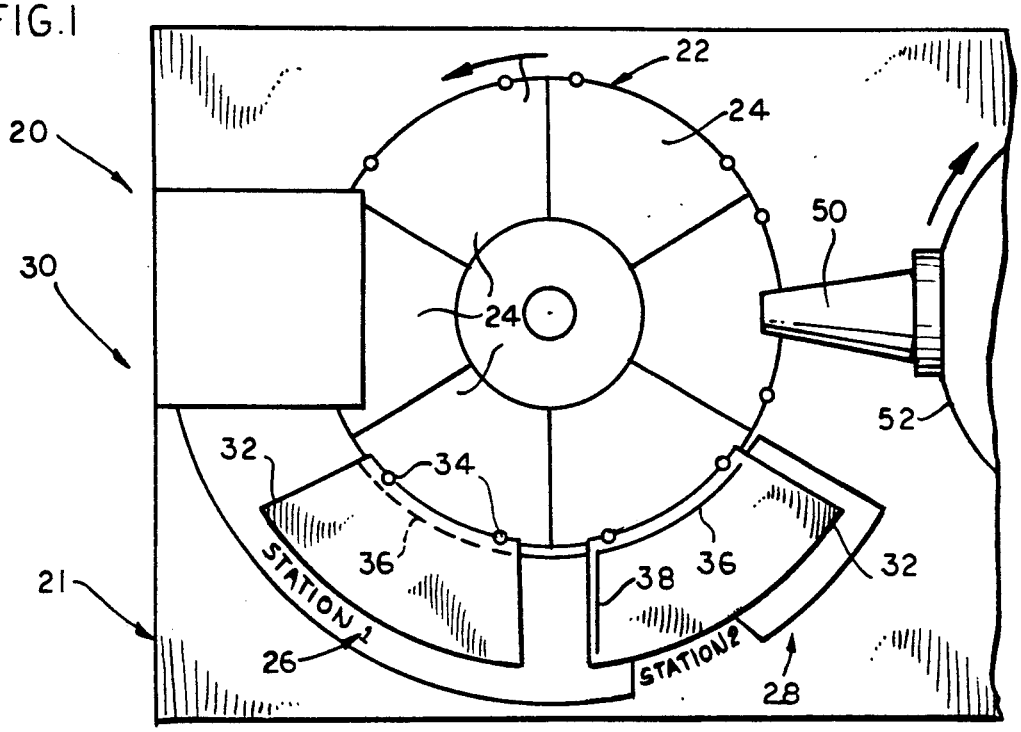
FIG. 1 is a diagrammatic view of a portion of a cup-forming machine in connection with which the invention may advantageously be utilized.

Referring now to the drawings, and initially to FIG. 1, there is shown therein a diagrammatic view of a portion of a cup-forming machine in connection with which the apparatus of the invention may advantageously be utilized. As previously indicated hereinabove, the invention is illustrated herein in connection with a typical cup machine designated generally by reference numeral 20, which has a rotating platform or table designated generally by the reference numeral 22. However, the invention may be utilized with other apparatus which indexes or otherwise moves in a predetermined path or direction, for generally applying a glue bead or glue pattern in directions either aligned with or transversely crossing or intersecting the path of movement of the apparatus or machinery.

In the illustrated embodiment, the cup machine platform is divided into six evenly spaced sections 24 which rotate in an incremental indexed or stepwise fashion into six corresponding fixed stations, of which two of the stations 26 (station 1) and 28 (station 2) are primarily of interest in connection with the present invention. At a so-called 0 station 30, a generally flat, arcuately-shaped, cup blank 32 is placed upon the platform 22. In this regard, the entire platform and related apparatus is, in turn, carried upon an enlarged frame or base portion 21. The cup blank 32 is held in place relative to the table 22 throughout its rotation by suitable means such as cup holder clips 34.

In station 1, as indicated at reference numeral 26, the blank 32 is positioned to have a first generally arcuate portion 36 of the glue pattern applied thereto for gluing or securing the bottom of the cup at a stage somewhat later in the cup forming process. At a second station 28, a second portion 38 of the glue pattern is applied which will form the side seam of the cup somewhat later in the process of assembly thereof. It will be noted that the arcuate glue pattern portion 36 is applied as the cup blank 32 indexes between station No. 1 at reference numeral 26 and station No. 2 at reference numeral 28. Accordingly this pattern portion 36 is shown in phantom line at station No. 1, and in full line at station No. 2.

Figure 2:
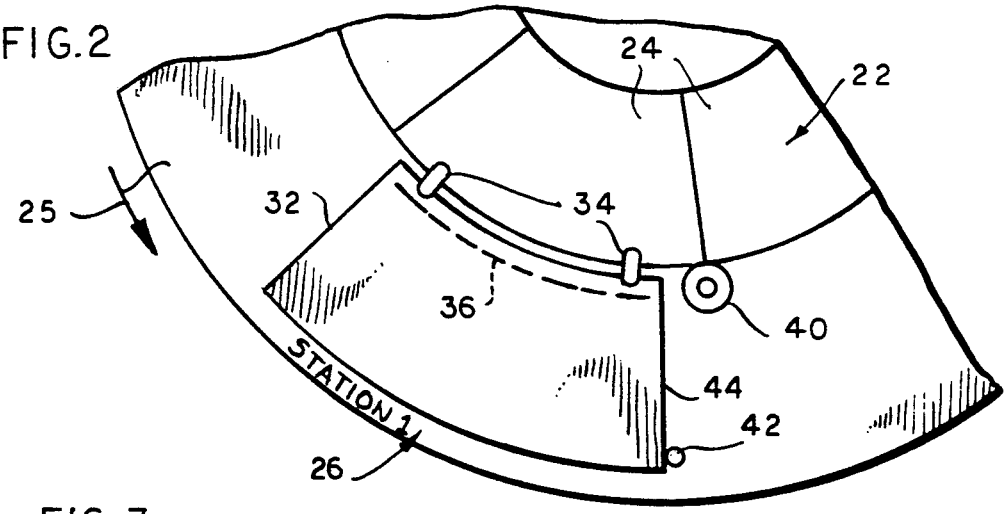
FIG. 2 is an enlarged partial view of the machine of FIG. 1.

Referring also to FIG. 2, the arcuate glue pattern portion 36 is applied to the cup blank 32 by a non-contact glue valve 40 which is positioned generally intermediate the stations 26 and 28. The glue valve 40 is also positioned for alignment with the surface of the cup blank or workpiece 32 and with the arcuate portion 36 of the desired pattern to be applied thereto as the platform 22 indexes. Control means, to be more fully described hereinbelow, turn the glue valve 40 on and off in a predetermined fashion to deposit glue upon the desired arcuate pattern portion 36 as the platform 22 and workpiece or cup 32 index.

In this connection, an edge sensor or sensor means diagrammatically indicated at reference numeral 42 senses the movement of a predetermined, and in the illustrated embodiment a leading edge portion of the workpiece or cup 32, past a predetermined point along the path of travel of the table 22. In response to the arrival of this edge 44, sensor 42 produces a glue start signal. An adjustable glue timer control, to be described later herein, produces a glue stop signal a selectable time after this glue start signal. A glue valve control means controls the glue valve 40 in response to these start and stop signals for respectively opening and closing the glue valve. The arrangement of the glue valve start and stop signals and the timing or time delay therebetween is such as to achieve the indicated arcuate portion of the pattern 36 as the cup blank 32 indexes beneath the glue valve 40 as it travels on the table 22 from station 1 (26) to station 2 (28).

At station No. 3, the cup blank 32 is wrapped around a mandrel 50 which is indexed about a second rotatable table 52 wherein the cup formation process is completed, as generally described hereinabove. However the further steps of the cup formation process form no part of the present invention, and hence will not be further described herein.

Figure 3:
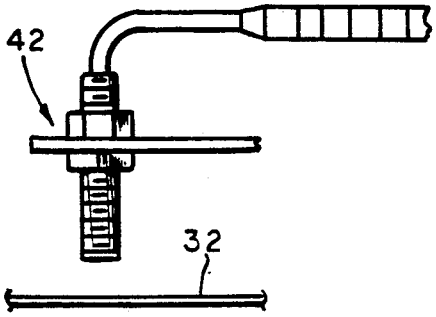
FIG. 3 is an enlarged partial view of a cup edge sensor in accordance with a preferred embodiment of the invention.

Referring briefly to FIG. 3, in the illustrated embodiment, the edge position sensor 42 comprises a short-range proximity mode fibre-optic type sensor of the type generally designated BAT23S which forms an extension or sensor element portion of a short range proximity mode sensor apparatus of the type generally designated SM512DB, available from Banner Engineering Corporation, 9714 10th Avenue North, Minneapolis, Minn. 55441.

Figure 4:
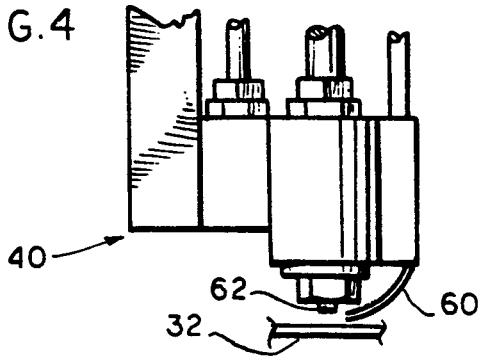
FIG. 4 is an enlarged partial side elevation of a first non-contact glue applying assembly in accordance with a preferred form of the invention.
Figure 5:
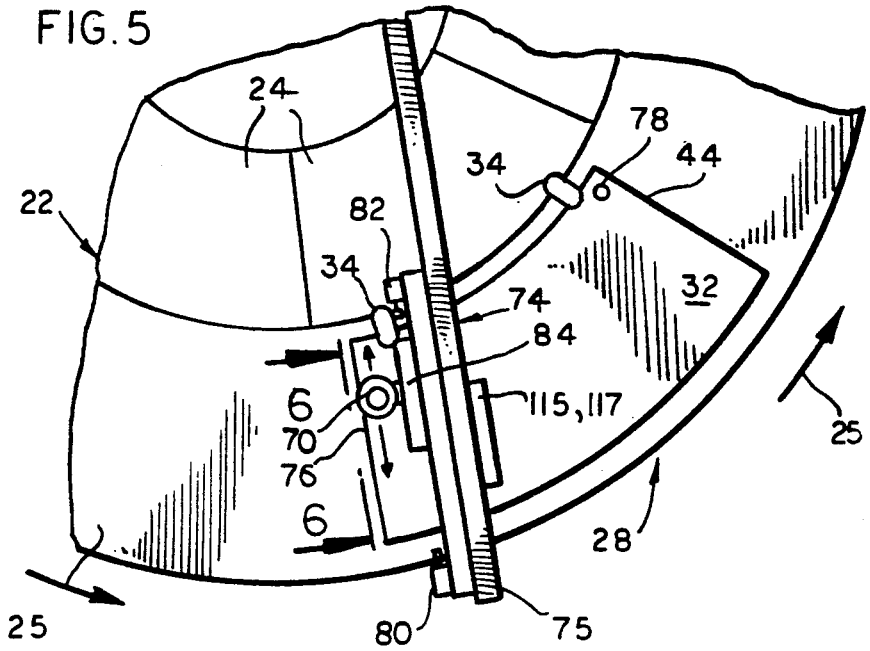
FIG. 5 is a partial top plan view of the apparatus of FIG. 1, illustrating diagrammatically a portion of a second non-contact glue applying apparatus in accordance with the invention.
Figure 6:
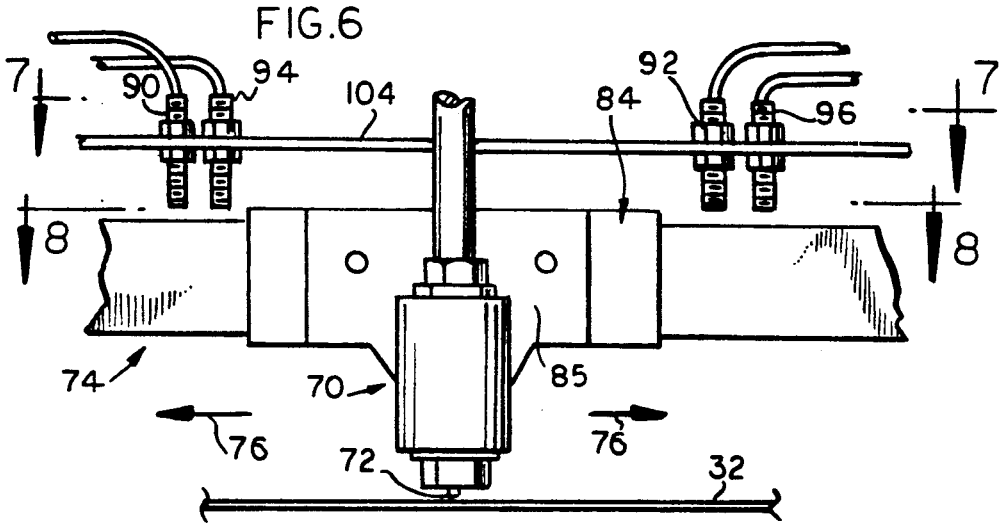
FIG. 6 is an enlarged partial side elevation, taken generally in the plane of the line 6—6 of FIG. 5.

Referring briefly to FIG. 4, the glue valve 40 is preferably a glue valve of the type designated Electromagnetic XV#79215 and available from Spraymation, Inc., 5320 N.W. 35th Avenue, Ft. Lauderdale, Fla. 33309. As described in the copending U.S. patent application Ser. No. 611,520 filed Nov. 13, 1990, this valve includes a movable tip wiper portion 60 which is advanceable and retractable to selectively cover and expose an outlet portion 62 of the glue valve 40. This wiper 60 is operative for not only wiping excess glue from the valve during operation, but also for covering the valve to generally prevent drying and clogging of glue therein during periods of non-use or non-operation thereof. As will be more fully described later herein, suitable further sensor means may be provided to determine a minimum speed of indexing of the table 22 below which sufficient time is available for advancing and retracting the wiper 60 relative to outlet 62 for either accomplishing cleaning of the same, or in the event of a shutdown of the apparatus for covering the glue valve outlet 62 to prevent drying of the glue and clogging.

Reference is next invited to FIGS. 5–8, wherein there is illustrated apparatus of the invention for applying the portion 38 of the glue pattern for use in forming the side seam of the completed cup. It will be recalled that this portion 38 of the pattern runs generally along a line intersecting or (in the illustrated embodiment transversely to the path of travel of the indexing table 22. It should be recognized that the principles of the invention, insofar as operation of the apparatus for applying this second glue pattern portion, are applicable to any device in which it is desired to apply a glue pattern in some direction other than one generally aligned with or parallel with the path of travel of a moving workpiece such as the cup blank 32.

In accordance with the illustrated embodiment, the apparatus of the invention includes a non-contact glue valve 70 having an outlet 72. A carrier assembly or carrier means generally designated by reference numeral 74 mounts the glue valve 70 for bidirectional motion along a line intersecting the path of travel 25 of the platform 22 as generally indicated by arrows 76, which path is generally transverse to the path of travel 25 of the cup blank 32 or other workpiece as it is carried by the platform 22. Control means, to be illustrated and described later herein, are provided for turning the glue valve 70 on and off in a predetermined fashion so as to deposit glue upon the facing surface of the cup blank 32 or other workpiece in the generally transverse portion 38 (see FIG. 1) of the desired pattern.

In the illustrated embodiment, this movement of the glue valve 70 generally in alignment with or along pattern portion 38, takes place while the workpiece is in a stationary position at station 2 (28), that is, between the steps in that stepwise indexed motion or rotation of the platform 22. A second edge sensor or sensor means 78 is provided for sensing the arrival of the same leading edge portion 44 of the cup blank or other workpiece 32 at station 2, and produces a corresponding edge control signal. The previously mentioned control means responds to this control signal for initiating movement of the carrier means 74 in one of the directions of the bidirectional motion 76 thereof to correspondingly propel the glue valve across the cup 32 to deposit a bead of glue in pattern 38 thereupon. When the glue valve 70 has reached one end point of its motion along line 76, it remains stationary, waiting for indexing of the next cup blank thereunder whereupon it can return in the opposite direction of its bidirectional motion 76 while depositing a glue bead in the same pattern portion 38 upon a subsequent cup blank. Hence, glue valve 72 moves in only one direction of its bidirectional motion 76 with respect to each cup blank which indexes thereunder so as to apply a seam of glue in pattern 38 in a single movement with respect to each cup blank. Sensor 78 is of the same type as described above with reference to sensor 42.

Carrier means 74 is mounted from a suitable overhead beam or frame-like support member 75. In the illustrated embodiment, the carrier means 74 comprises an assembly known as a band cylinder available, for example, from Tol-O-Matic, 1028 South 3rd Street, Minneapolis, Minn. 55415 and preferably of the type generally designated BC100-100. However, other equivalent structures may be utilized without departing from the invention. Among other things, this band cylinder assembly includes shock absorbers 80, 82 at opposite ends thereof to abut against corresponding opposite ends of a carrier or carriage portion 84 thereof which carries the glue valve 70 as the carrier 84 approaches opposite ends of its motion 76 along the band cylinder 74.

Figures 8, 9:
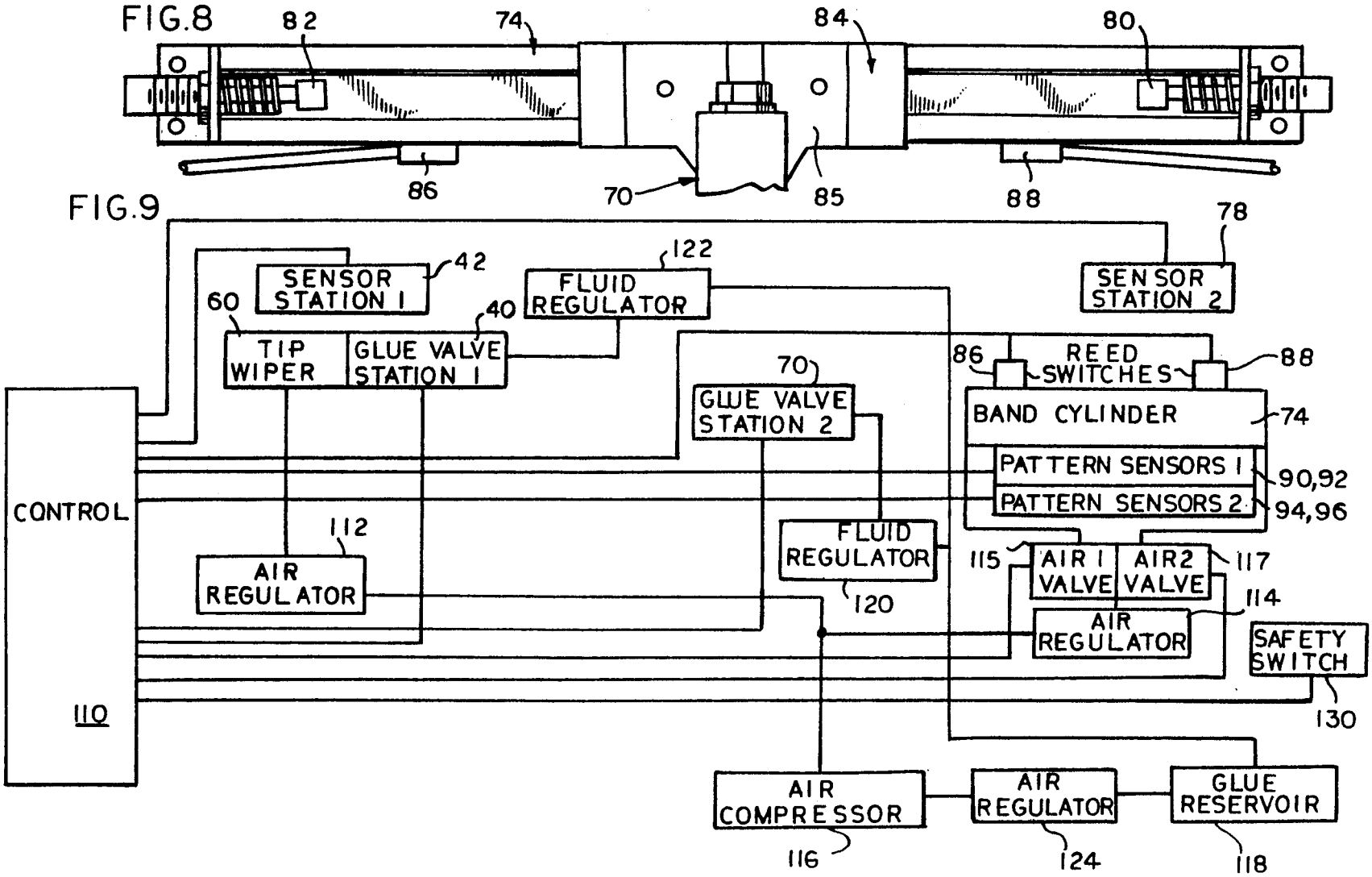
FIG. 8 is a view taken generally in the plane of FIG. 6.
FIG. 9 is a functional block diagram illustrating operation of the non-contact gluing system of the invention in connection with the cup forming machinery of FIG. 1.

Additionally, and as also illustrated in FIG. 8, the band cylinder 74 is provided with end sensor means comprising respective reed switches 86, 88 which are selectively positionable along a side surface thereof for detecting the arrival of the carrier or carriage portion 84 at any given point along the linear travel thereof along band cylinder 74. These sensors 86 and 88 may therefore be placed along the band cylinder to determine respective starting and ending points of each stroke or movement of the glue valve; that is, at which end of the band cylinder 74 the glue valve is between strokes, and to produce corresponding end position signals. The control means of the invention as will be described more fully later herein utilizes these end position signals to determine at which end of the band cylinder 74 the glue valve has come to rest following each operation thereof.

Figure 7:
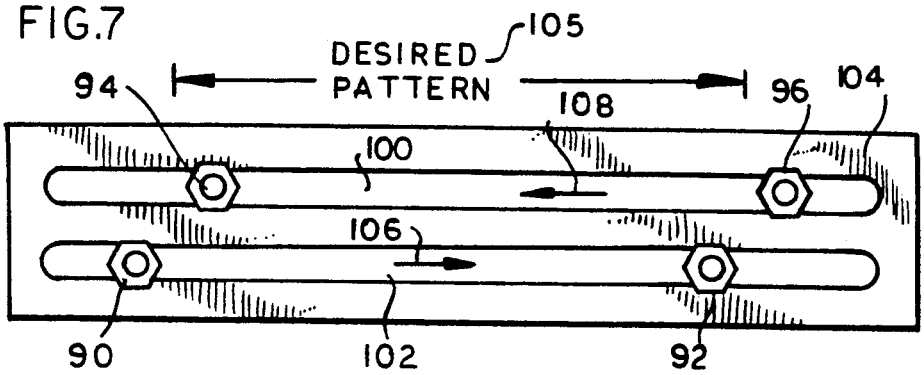
FIG. 7 is a top plan view taken generally in the plane of the line 7—7 of FIG. 6.

Referring now also to FIG. 7, additional glue valve position sensors 90, 92 and 94, 96 are selectably movable relative to respective tracks 100, 102 provided in a mounting plate 104 which mounts the same somewhat above the band cylinder 74. Preferably these sensors 90, 92 and 94, 96 comprise proximity sensors of the same type as sensors 42 and 78 described hereinabove. These sensors 90, 92 and 94, 96 determine the relative points in the path of travel of the glue valve 70 along the band cylinder 74, at which respective open and close signals for opening and closing the valve are to be produced in order to initiate and terminate the deposit of the desired pattern portion 38 upon the cup blank 32. It will be noted that the sensors 90 and 92 are utilized to determine the points of opening and closing the valve as the same moves in a first direction 106, whereas the sensors 94 and 96 determine the opening and closing points as the valve moves in the opposite direction 108. Sensors 90, 92 and 94, 96 are activated by a white stripe (not shown) which is applied across the top of a valve mounting bracket 85, attached to the carrier 84. It will be noted that the valves are placed somewhat ahead of the beginning and end of the desired pattern as indicated at reference numeral 105, for each direction of travel. This takes into account the time delay inherent between the actual opening of the valve and the time at which the glue actually reaches the surface of the cup 32 having traveled through the glue valve 70 and to and through the outlet 72 thereof. The positions of the respective sensors 90–96, inclusive, may be adjusted as desired for given speeds of operation of the apparatus, to provide the necessary delay times to deposit the desired pattern 105. The band cylinder 74 thus travels along a path generally in parallel to the pattern portion 38 upon which glue is to be deposited by valve 70. Hence, in operation, the control means is responsive to respective open and close signals produced by these sensors 90–96 for opening and closing the glue valve at predetermined positions along the path of travel thereof for initiating and terminating the dispensing of glue in such a manner as to deposit the glue upon the workpiece surface in the pattern portion 38 as desired.

The selection of which of the sets of sensors 90, 92 or 94, 96 will control the opening and closing of the valve is determined by the control means in accordance with the starting position of the valve on each pass over a cup blank 32. It will be recalled that this starting position is in turn determined by which of the sensors 86 or 88 detects the presence of the valve 70 at the time at which the signal to propel the valve across the cup blank 32 is given by the sensor 78.

Referring briefly to FIG. 9, the components thus far described, including the control means 110 referred to hereinabove in connection with the operation thereof are illustrated in block diagram form. In addition to the components described hereinabove, it will be noted that the tip wiper 60 and the band cylinder 74 comprise pneumatic or compressed air operated devices. Accordingly, suitable pneumatic devices, including suitable air regulators 112, 114 as well as an air compressor 116 are provided for use therewith. The air regulator 114 supplies air through one of two air valves 115 and 117 under the control of control means 110, to apply air pressure to one or the other side of band cylinder 74 in accordance with the direction in which the glue valve 70 is to be moved. Preferably, air valves 115, 117 are of the type designated as No. B21 CPM-611-FA-152 available from MAC Valves Inc., P.O. Box 111, 30569 Beck Rd., Wixom, Mich. 48096. Preferably a glue reservoir 118 for supplying the respective glue valves is also supplied with compressed air for supplying glue through connecting lines to the respective valves. Suitable fluid regulators 120 and 122 are supplied for the respective valves in this regard as well as an air regulator 124 for regulating the supply of compressed air to the glue reservoir 118.

A safety switch 130 is provided for developing a safety control signal in the event a safety shield or shroud 131 (shown diagrammatically) which normally covers the gluing apparatus at stations 1 and 2 is removed. Preferably the control system is responsive to the signal produced in response to removal of the safety shield for rendering the station 1 and station 2 sensors 42 and 78 and the band cylinder 74 inoperative. In order to begin operation again, the safety shield must be replaced and a reset button 135 (see FIG. 14B) must be depressed.

Figure 10:
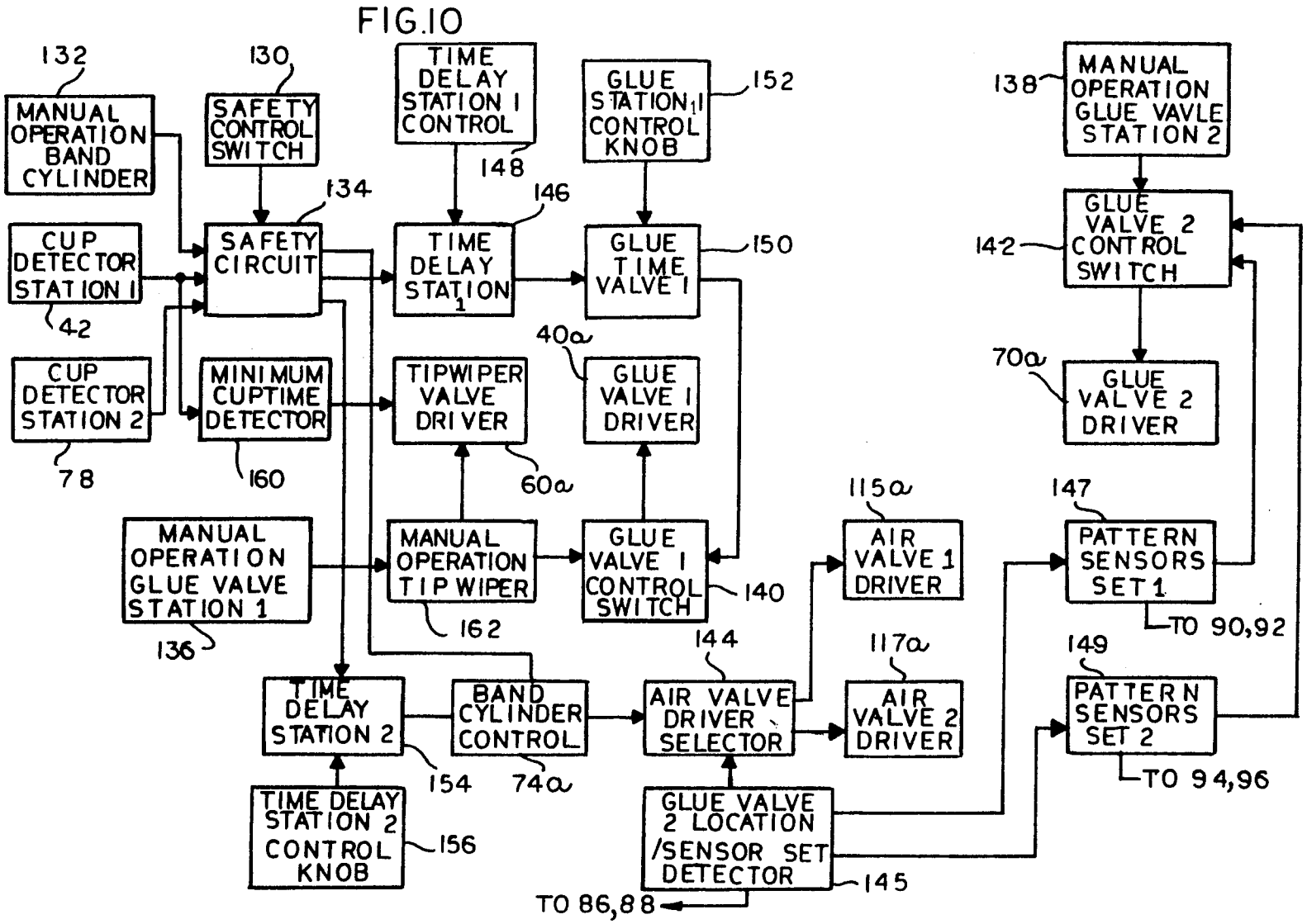
FIG. 10 is a functional block circuit diagram illustrating the control circuit of the gluing apparatus of the invention.

FIG. 10 is a functional block diagram of the control circuit 110 in connection with other electrical control members or components associated with the apparatus of the invention as described hereinabove. The connections to the sensors described hereinabove are indicated in FIG. 10 by like reference numerals. Valve driven components of the electrical control system are indicated with like reference numerals to the valve components which they control together with the suffix a.

Manual operation of the band cylinder is provided for under the control of a manually accessible switch 132. This permits the glue valve 70 to be manually driven bidirectionally across the band cylinder to aid in initial set up of the system for operation with a particular system such as the cup gluing apparatus 20, and also to accommodate different speeds of operation of the cup gluing apparatus 20, as well as different sizes or configurations of cups to which glue patterns are to be applied.

As previously mentioned, operation of the band cylinder, including manual operation, as well as the operation of the cup detector sensors 42 and 78 is controlled by a safety circuit 134 which is, in turn, under the control of the safety control switch 130 as described above. It is also possible to manually operate the respective glue valves 40 and 70 by way of manually actuatable switches 136, 138.

The glue valve drivers for the respective glue valves are indicated by reference numerals 40*a* and 78*a*. The drivers are controlled by respective glue valve control switch circuits 140, 142. It will be recalled that the glue valve 40 is turned on and off in response to the respective pattern sensors 90, 92 or 94, 96. This is accomplished by respective pattern sensors set 1/set 2 input circuits 147 and 149. These input circuits are in turn selected in accordance with the starting position of the glue valve as detected by sensors 86, 88 by a glue valve 2 location 1 sensor set detector circuit 145. The starting position sensors 86,88 also control the selection of one or the other of air valves 115, 117 by way of air valve drivers 115*a* and 117*a* and air valve driver selector 144.

In operation, the glue valve 40 is responsive initially to the signal from the cup detector 42 which passes through the safety circuit 134 and also through an adjustable time delay 146. An adjustment member or control knob 148 is provided for selecting this time delay. This time delay permits the actual start of the glue pattern to be delayed a selectable amount following detection of the leading edge of the cup blank, to allow for adjustment of the starting point of the glue pattern portion 36 as desired. As previously mentioned, the glue valve 40 is turned off a selectable time delay following the start signal as given by the cup detector sensor 42. The time delay is provided by a glue timer valve 150 and is adjustable or selectable at a control knob 152.

A similar time delay between the detection of the cup edge at sensor 78 and the sending of the control signal to open the glue valve 70 is also provided at a time delay circuit 154 and is adjustable by way of a control knob 156. Hence the start of the pattern portion 38 may also be delayed a selectable time following detection of the leading edge of the cup at station 2 to allow for the cup to come to a complete rest, for example. However, rather than controlling the glue valve 70, this time delay controls the initiation of movement of the valve along the band cylinder 74 by way of a band cylinder control switch 74*a*.

As previously mentioned, the tip wiper 60 provided for the valve 40 operates in similar fashion to what is described in the above-referenced copending application. In this regard, the wiper 60 is operative only when there is a predetermined minimum speed of the indexing operation as detected by a minimum cup time detector circuit 160. The tip wiper may also be manually operated when desired by way of a manual operation tip wiper control switch 162.

Figure 11:
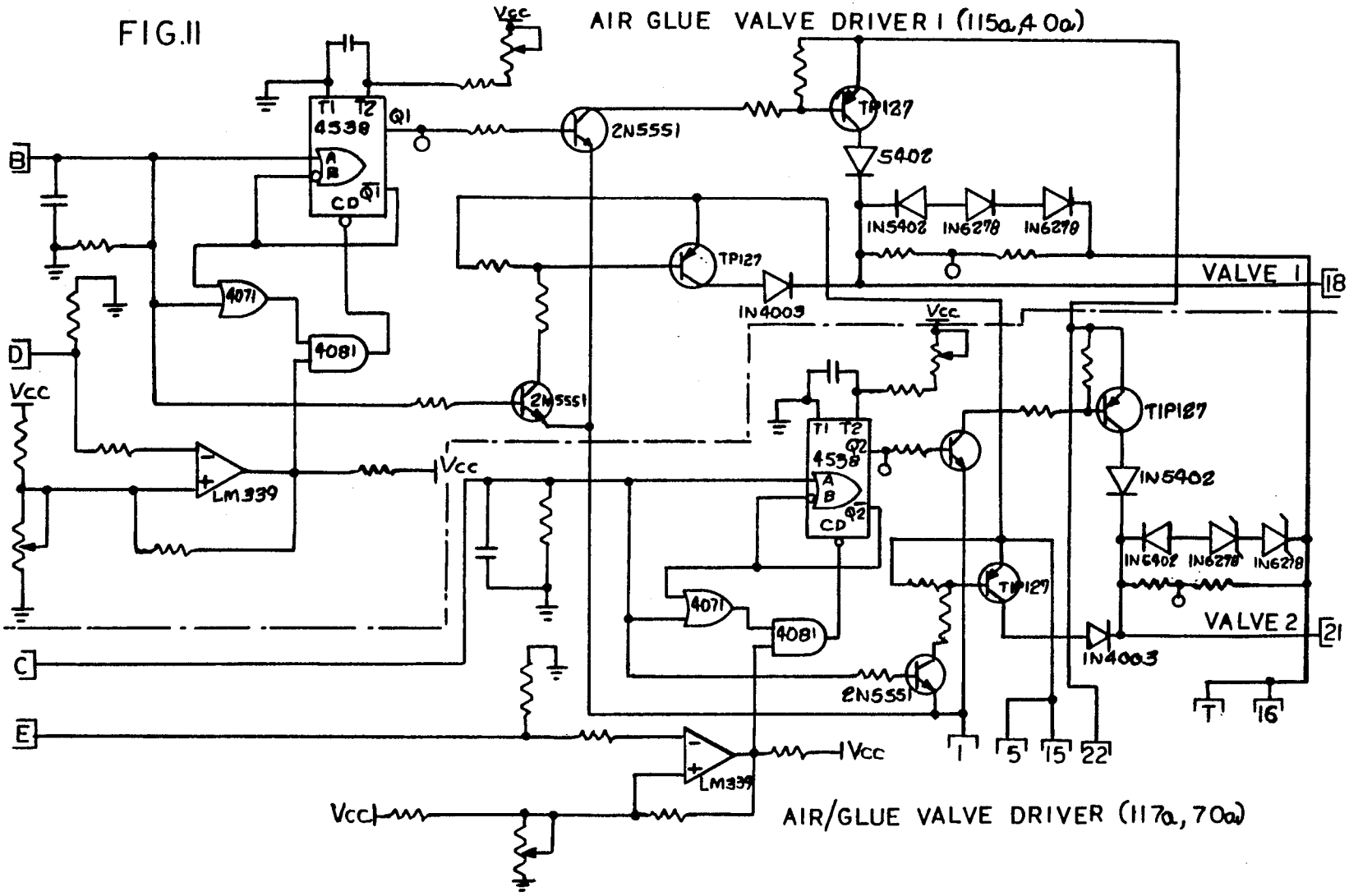
FIG. 11 is a schematic circuit diagram of a portion of the control circuitry in accordance with a preferred form of the invention.
Figure 12:
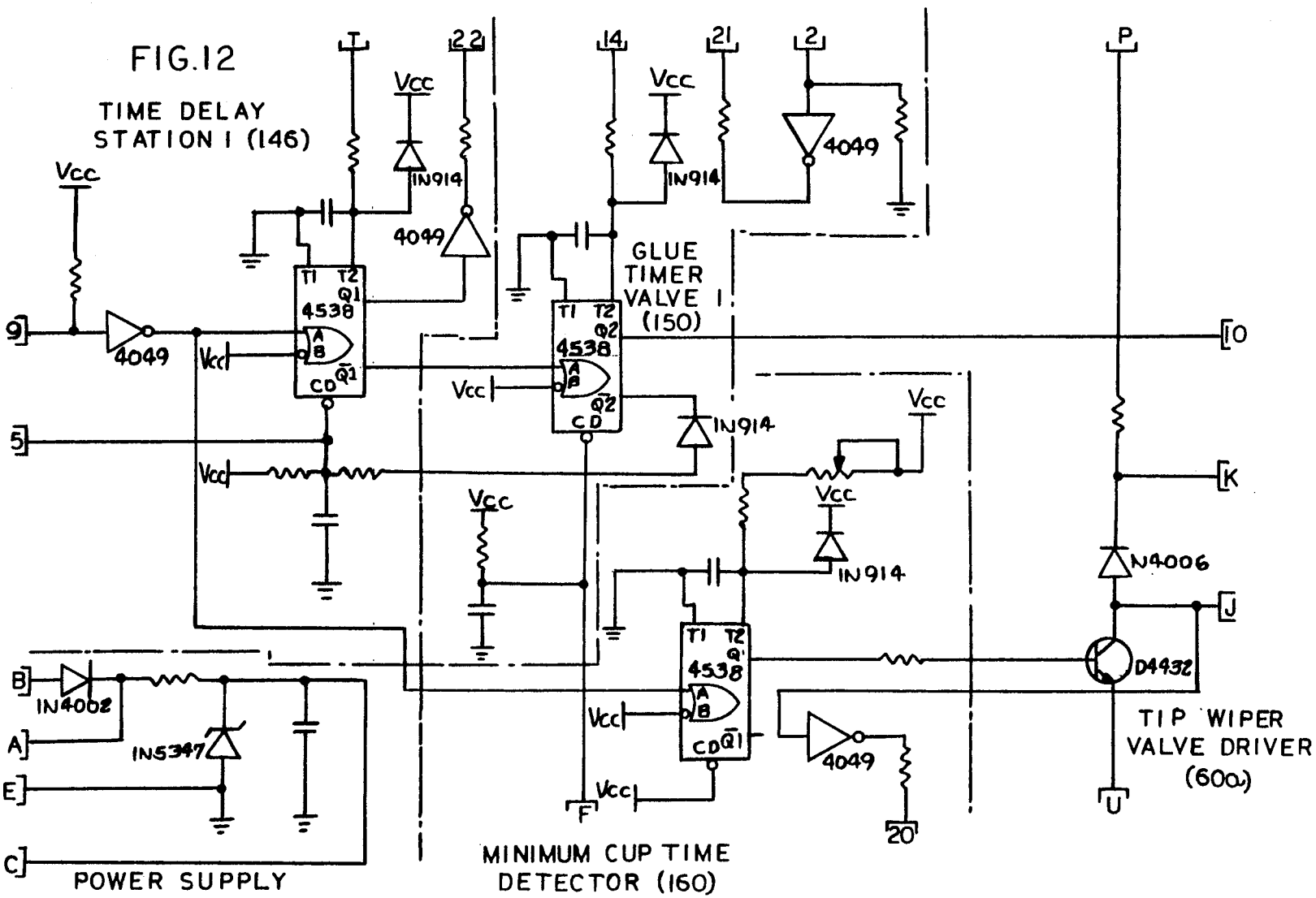
FIG. 12 is a schematic circuit diagram of a portion of the control circuitry in accordance with a preferred form of the invention.
Figure 13:
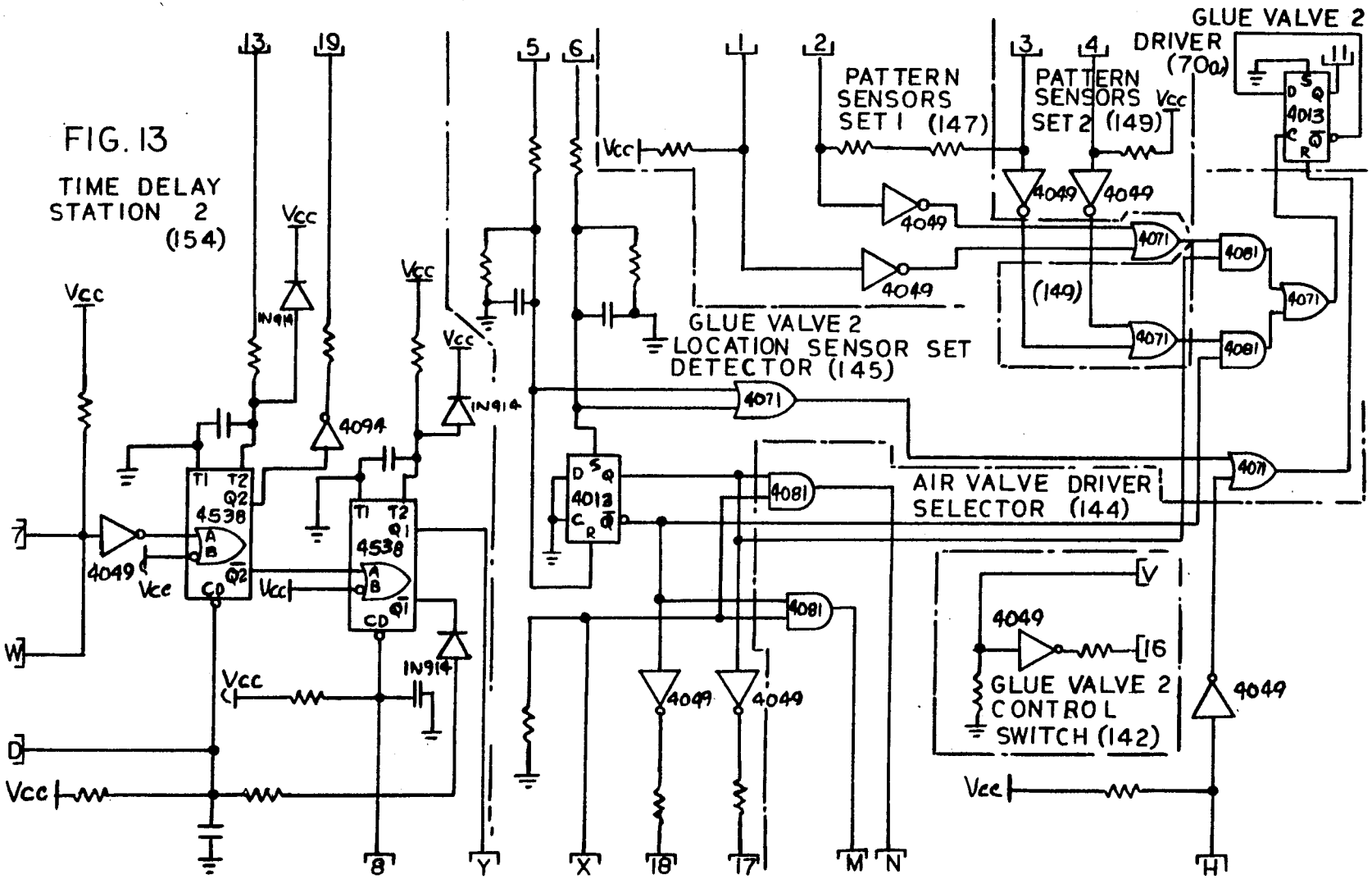
FIG. 13 is a schematic circuit diagram of a further control circuit in accordance with a preferred form of the invention.

FIG. 14 illustrates an over all circuit layout configuration corresponding to the block diagram of FIG. 10. The details of the components indicated as —1081 logic board" and the two "1082 boards" which are identical circuit boards are illustrated respectively in FIGS. 11 (the 1082 board) and in FIGS. 12 and 13 (the 1081 board). The portions of these circuit boards corresponding generally to the functions indicated in the functional blocks of FIG. 10 have been indicated generally by like designations in FIGS. 11, 12 and 13.

Figure 14A:
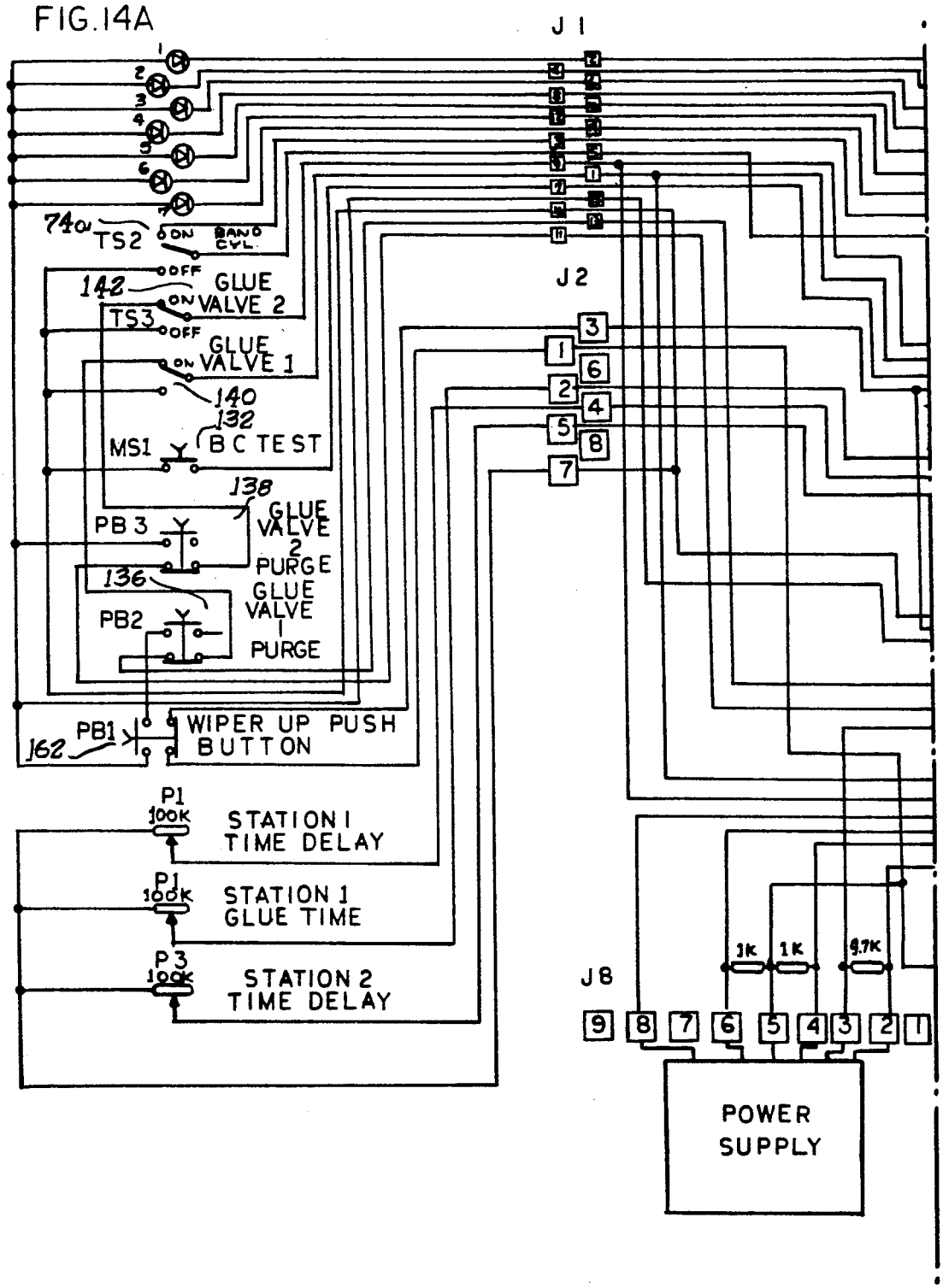
FIGS. 14A and 14B taken together, form a block diagram illustrating the electrical connections between the various circuit portions of the invention as illustrated in FIGS. 11, 12 and 13, as well as electrical connections with the other components of the invention as indicated in FIG. 9.
Figure 14B:
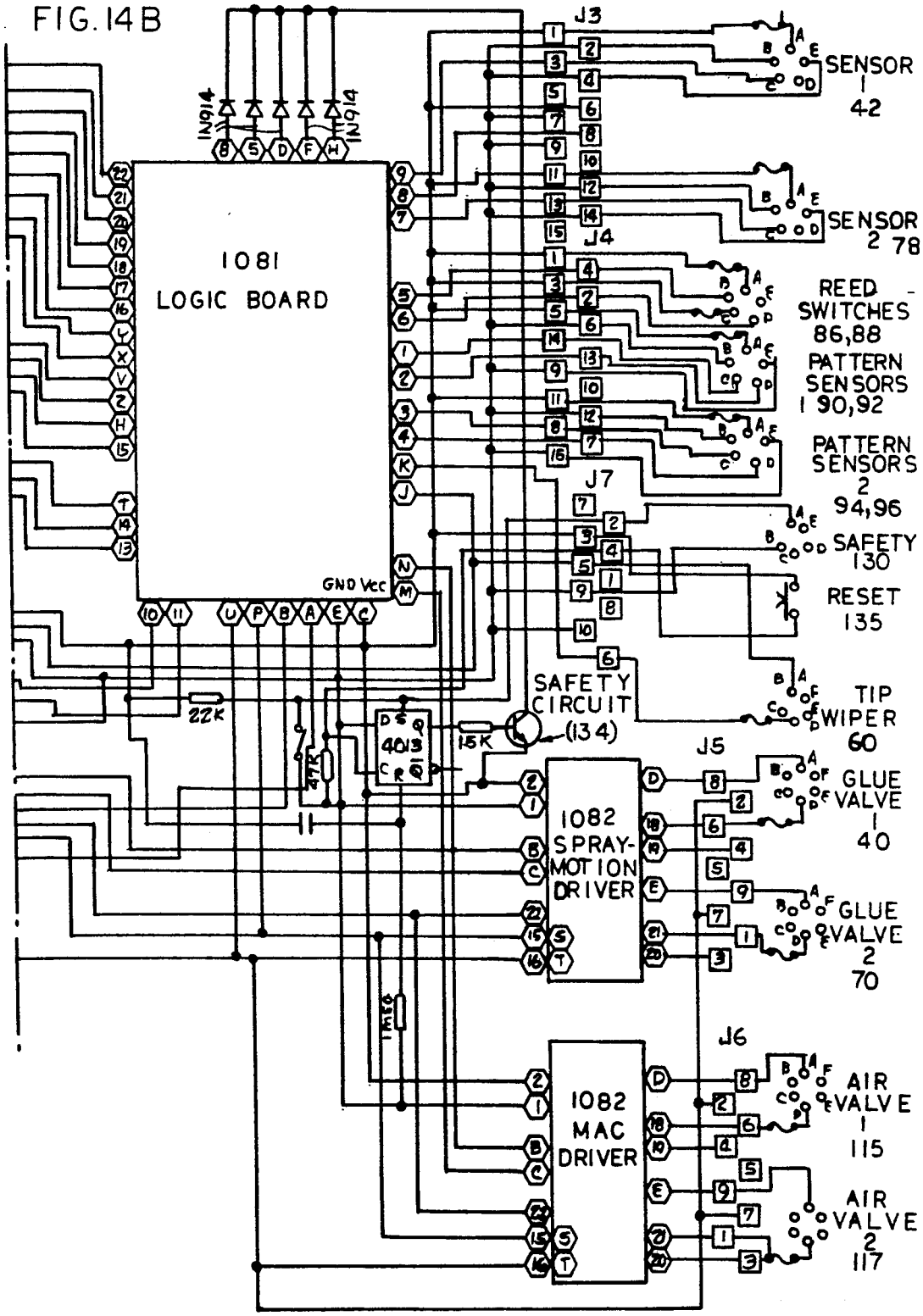

Referring briefly to FIG. 14A, the glue valve purge manual control switches 136, 138 are preferably push-/push type of switches—that is, each switch activates its respective glue valve when depressed and deactivates the glue valve when it is pressed again. The purge switch will not activate the glue valve if its corresponding glue valve toggle switch 140, 142 is in the off position. A similar type of on/off control switch 74*a* is also provided for the band cylinder. Each of these switches cuts off the signals to its respective function.

What has been illustrated and described hereinabove is a novel and improved non-contact glue system for applying glue in a given pattern to a workpiece such as a cup blank which moves along a given path of travel. The present invention offers a number of benefits and advantages when compared to prior art types of glue pot and/or stencil gluing apparatus as have been described hereinabove. The use of the electronically controlled non-contact glue valve greatly simplifies and enhances the gluing process. Since the system of the invention is electronically driven, the glue pattern can be very precisely controlled. Less glue is required for each pattern with this process than with a glue wheel or stencil type of process. Moreover, a glue pattern will not be applied unless the presence of a cup has been detected, as described above. That is, glue is not applied to the cup table or platform. This eliminates the need to stop the process and scrape glue from the table if cups are not properly fed from the die-cutting section on each index of the table. Also, to change the patterns of glue for a different cup style or for a different machine speed, the operator need only adjust a few control knobs, and sometimes adjust sensor locations and/or valve locations. Hence, set-up time, replacement time and rebuilding time is greatly reduced with the system in accordance with the present invention.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The invention is claimed as follows:

1. Apparatus for applying a predetermined glue pattern to a predetermined surface of a cup blank or similar workpiece, which workpiece is moved in a stepwise, indexed fashion, such that said predetermined surface thereof follows a given, generally arcuate path of travel, said predetermined pattern including a first, generally linear portion which extends along a line intersecting said given path of travel, said apparatus comprising: a non-contact glue valve having an outlet; carrier means for mounting said glue valve for bidirectional motion along said line intersecting said given path of travel with the outlet thereof in alignment with said first portion of said predetermined pattern and spaced closely above said predetermined surface of said workpiece; control means for turning said glue valve on and off in a predetermined fashion for depositing glue upon said predetermined surface of said workpiece in said first portion of said pattern while said workpiece is in a stationary position between steps in said stepwise indexed motion thereof; edge sensor means for sensing the arrival of a predetermined portion of said workpiece in said stationary position intermediate steps of said stepwise indexing thereof, and for producing a corresponding edge control signal; wherein said control means further includes carrier control means for controlling said bidirectional motion of said carrier means, said carrier control means being responsive to said edge control signal for initiating movement of said carrier means in either direction of said bidirectional motion thereof in such a manner that said glue valve deposits the same said first portion of said pattern on each of a succession of workpieces as the same are indexed into registry with said glue valve, with the glue valve depositing said first portion of said pattern upon another said workpiece each time the glue valve reverses its direction in said bidirectional motion thereof in response to said edge sensor means; wherein said control means comprises glue valve position sensor means for detecting a plurality of predetermined positions of said glue valve along said line of bidirectional motion thereof and for producing respective open and close signals for opening and closing said glue valve at selected ones of said predetermined positions of said glue valve for initiating and terminating the dispensing of glue in such a manner as to deposit the same upon the workpiece surface in said first portion of said pattern in both directions of travel of said glue valve, compensating for time delays between opening and closing of said glue valve and the time at which glue actually reaches and ceases to reach the surface of the workpiece in each of the directions of motion, and wherein said control means are responsive to said open and close signals for respectively opening and closing said glue valve; wherein said glue valve position sensor means comprises two independent sets of glue valve position sensors located at relatively offset positions, each set for initiating and terminating the dispensing of glue by said glue valve in one direction of said bidirectional motion thereof.

2. Apparatus according to claim 1 wherein said carrier means comprises a band cylinder assembly mounted generally in parallel with said first portion of said predetermined pattern and carrier bracket means for mounting said glue valve to said band cylinder assembly.

3. Apparatus according to claim 1 wherein said carrier means defines opposite extreme ends of said bidirectional motion of said glue valve and further including end position sensor means for producing end signals corresponding to the position of said glue valve at one of the two ends said bidirectional motion thereof.

4. Apparatus according to claim 1 wherein said carrier means defines opposite extreme ends of said bidirectional motion of said glue valve and further includes end sensor means for determining respective starting and ending positions of said glue valve at either of said extreme ends of said bidirectional motion thereof and producing corresponding end position signals and wherein said control means are responsive to said end position signals for selecting one of said independent sets of glue valve position sensors for initiating and terminating the dispensing of glue at ones of said predetermined positions of said glue valve relative to each direction of said bidirectional motion of said glue valve.

5. Apparatus according to claim 2 wherein said second control means includes edge sensor means for sensing the movement of a predetermined edge portion of said workpiece past a predetermined point along said given path of travel and for producing a glue start signal, an adjustable glue timer responsive to said edge control signal for producing a glue stop signal a selectable time thereafter, and glue valve control means responsive to said glue start signal for opening said glue valve and responsive to said glue stop signal for closing said glue valve.

6. Apparatus according to claim 5 wherein said control means further includes adjustable time delay means for delaying opening of said glue valve for an adjustable time following said glue start signal for delaying the start of deposition of said second portion of said glue pattern by a predetermined time and distance relative to the time and position of sensing of said edge by said edge sensor means.

7. Apparatus according to claim 2 and further including wiper means selectively advanceable and retractable relative to said second glue valve outlet to alternatively permit dispensing of glue therethrough, covering said outlet during periods of non-use for preventing drying and clogging of glue within said glue valve outlet, and wiping excess glue from said glue valve outlet following dispensing of glue therefrom.

8. Apparatus according to claim 7 wherein said second control means includes tip wiper control means for controlling the operation of said tip wiper in a predetermined fashion.

9. Apparatus according to claim 8 wherein said control means includes includes speed sensor means for sensing the frequency of steps in the stepwise indexed movement of said workpiece and for generating a corresponding speed control signal and wherein said tip wiper control means is responsive to said speed control signal for actuating said tip wiper to advance and cover said second glue valve outlet when said speed control signal crosses a predetermined threshold value corresponding to a predetermined minimum frequency of stepwise indexing of said workpiece.

10. Apparatus according to claim 1 wherein said apparatus includes a safety shield covering at least said glue valve and said carrier means and covering said workpiece when in registry with said glue valve, and wherein said control means include safety switch means responsive to removal of said safety shield for producing a safety signal and means responsive to said safety signal for rendering said edge sensor means and said carrier means inoperative.

11. Apparatus according to claim 10 wherein said control means further includes selectively actuatable purge means for producing a purge signal and means responsive to said purge signal for opening said glue valve independently of said safety signal.

12. Apparatus according to claim 1 wherein said glue valve position sensors are independently adjustably positionable relative to the bidirectional motion of said carrier means and wherein said control means further includes manually actuatable glue valve positioning means for manually activating said carrier means for bidirectionally moving said glue valve along said path of travel independently of the presence or absence of a workpiece in alignment therewith for adjusting the position of the glue valve position sensor means for opening and closing said glue valve so as to achieve the deposit of glue in said first portion of said predetermined pattern.

13. Apparatus for applying a predetermined glue pattern to a predetermined surface of a cup blank or similar workpiece, which workpiece is moved in a stepwise, indexed fashion, such that said predetermined surface thereof follows a given, generally arcuate path of travel, said predetermined pattern including a first, generally linear portion which extends along a line intersecting said given path of travel, said apparatus comprising: a non-contact glue valve having an outlet; carrier means for mounting said glue valve for bidirectional motion along said line intersecting said given path of travel with the outlet thereof in alignment with said first portion of said predetermined pattern and spaced closely above said predetermined surface of said workpiece; control means for turning said glue valve on and off in a predetermined fashion for depositing glue upon said predetermined surface of said workpiece in said first portion of said pattern while said workpiece is in a stationary position between steps in said stepwise indexed motion thereof; edge sensor means for sensing the arrival of a predetermined portion of said workpiece in said stationary position intermediate steps of said stepwise indexing thereof, and for producing a corresponding edge control signal; wherein said control means further includes carrier control means for controlling said bidirectional motion of said carrier means, said carrier control means being responsive to said edge control signal for initiating movement of said carrier means in either direction of said bidirectional motion thereof in such a manner that said glue valve deposits the same said first portion of said pattern on each of a succession of workpieces as the same are indexed into registry with said glue valve, with the glue valve depositing said first portion of said pattern upon another said workpiece each time the glue valve reverses its direction in said bidirectional motion thereof in response to said edge sensor means; wherein said control means comprises glue valve position sensor means for detecting a plurality of predetermined positions of said glue valve along said line of bidirectional motion thereof and for producing respective open and close signals for opening and closing said glue valve at selected ones of said predetermined positions of said glue valve for initiating and terminating the dispensing of glue in such a manner as to deposit the same upon the workpiece surface in said first portion of said pattern in both directions of travel of said glue valve, compensating for time delays between opening and closing of said glue valve and the time at which glue actually reaches and ceases to reach the surface of the workpiece in each of the directions of motion, and wherein said control means are responsive to said open and close signals for respectively opening and closing said glue valve wherein said predetermined pattern also includes a second portion generally in alignment with said given path of travel and further includes a second non-contact glue valve having an outlet; mounting means for mounting said second glue valve with said outlet thereof spaced closely above said predetermined surface of said workpiece for alignment with said second portion of said pattern as said workpiece is indexed along said given path of travel, and second control means for turning said second glue valve on and off in a predetermined fashion for depositing glue upon said predetermined portion of the workpiece in said second portion of said pattern as said workpiece indexes along said given path of travel.

* * * * *